US005487687A

United States Patent [19]

Idzikowski et al.

[11] Patent Number: 5,487,687

[45] Date of Patent: Jan. 30, 1996

[54] MIDSECTION AND COWL ASSEMBLY FOR AN OUTBOARD MARINE DRIVE

[75] Inventors: George D. Idzikowski, Oshkosh; Wayne M. Jaszewski, Jackson; George E. Phillips, Oshkosh, all of Wis.

[73] Assignee: Brunswick Corporation, Lake Forest, Ill.

[21] Appl. No.: 276,477

[22] Filed: Jul. 18, 1994

[51] Int. Cl.[6] ..... B63H 21/00

[52] U.S. Cl. ..... 440/77; 440/900; 440/88

[58] Field of Search ..... 440/53, 52, 55–57, 440/76–78, 900, 88, 89; 184/1.5; 123/195 P; 181/251, 260; 60/310

[56] References Cited

U.S. PATENT DOCUMENTS

| | | | |
|---|---|---|---|
| 2,091,247 | 8/1937 | Williams, Jr. | 440/53 |
| 4,523,556 | 6/1985 | Suzuki | 123/196 W |
| 4,607,723 | 8/1986 | Okazaki | 440/89 |
| 4,668,199 | 5/1987 | Freund et al. | 440/89 |
| 4,698,037 | 10/1987 | Watanabe et al. | 440/78 |
| 4,708,673 | 11/1987 | Dunham et al. | 440/77 |
| 4,800,854 | 1/1989 | Boda et al. | 123/195 P |
| 4,828,519 | 5/1989 | Watanabe | 440/88 |
| 4,875,883 | 10/1989 | Slattery | 440/77 |
| 4,932,909 | 6/1990 | Curtis et al. | 440/77 |
| 4,940,402 | 7/1990 | McCormick | 418/154 |
| 5,069,643 | 12/1991 | Westberg et al. | 123/195 P |
| 5,118,316 | 6/1992 | Kakizaki et al. | 440/89 |
| 5,163,394 | 11/1992 | Koishikawa et al. | 123/196 W |
| 5,199,914 | 4/1993 | Marsh | 184/1.5 |
| 5,232,387 | 8/1993 | Sumigawa | 440/900 |
| 5,309,877 | 5/1994 | Shigedami et al. | 440/900 |

*Primary Examiner*—Edwin L. Swinehart
*Attorney, Agent, or Firm*—Andrus, Sceales, Starke & Sawall

[57] ABSTRACT

An outboard marine drive having a midsection between the upper power head and the lower gear case and having a removable midsection cowl assembly including first and second cowl sections. The midsection housing includes an oil sump in one embodiment and further includes an exhaust passage partially encircled by cooling water and partially encircled by engine oil for muffling engine exhaust noise. The midsection housing also has an oil drain arrangement providing complete and clean oil draining while the outboard drive is mounted on a boat and in the water wherein the operator can change oil without leaving the confines of the boat and entering the water.

26 Claims, 7 Drawing Sheets

FIG. 1
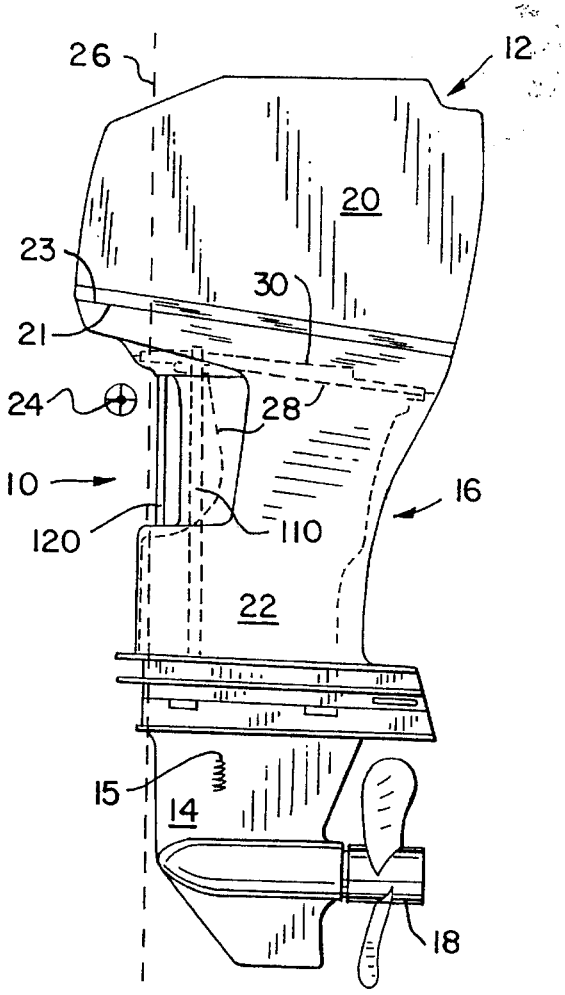
FIG. 6
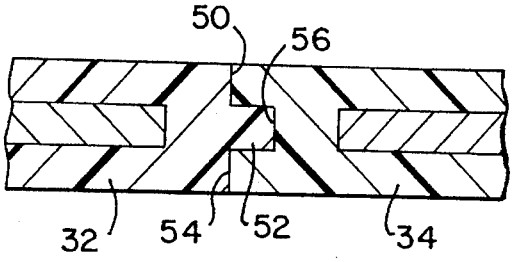
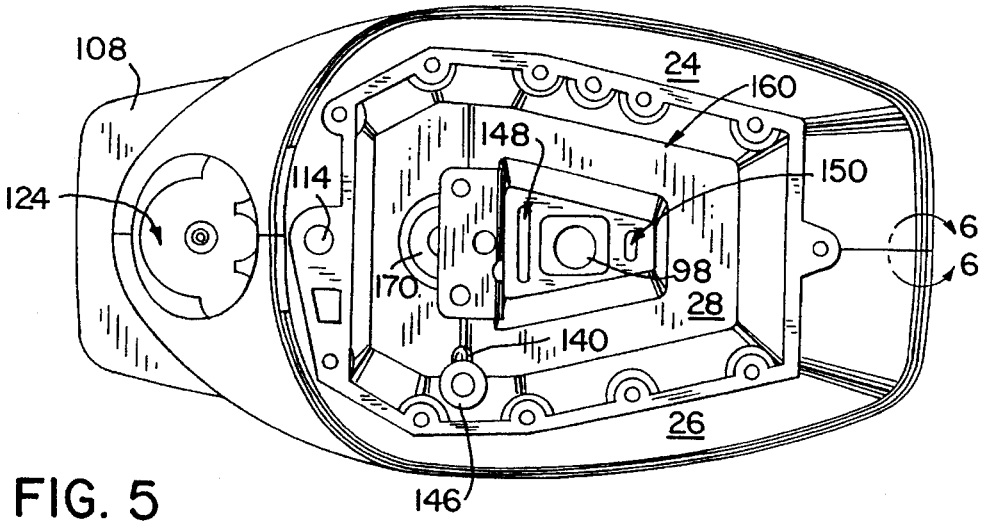
FIG. 5

MIDSECTION AND COWL ASSEMBLY FOR AN OUTBOARD MARINE DRIVE

BACKGROUND OF THE INVENTION

The present invention relates to outboard marine drives, and more particularly to a new midsection housing and cowl assembly for enclosing the midsection housing of an outboard marine drive.

An outboard marine drive generally includes an upper engine portion and a lower gear case. Typically, the two portions are joined by a driveshaft housing which includes a driveshaft, an exhaust passage, supply and return cooling water passages, and in some engine configurations, an integral oil sump. Other configurations requiring an oil sump have a separate reservoir mounted on the outboard drive.

There are several drawbacks to this configuration including producing excessive noise from the exhaust system, exposing the operator of the outboard drive to the hot oil sump cavity, allowing the hot oil sump cavity to be susceptible to contact with the cool water where the marine drive operates. Such exposure prevents maintaining consistent oil temperature and, in the case of operating in salt water, causes the water to evaporate leaving an unsightly salt residue which builds up and is difficult to remove. Further, an exposed die-cast driveshaft housing requires special sanding and preparation to produce a customer acceptable finish.

SUMMARY OF THE INVENTION

The present invention includes a new midsection housing and a 2-piece cowl assembly enclosing the midsection housing which overcome the above stated disadvantages of prior configurations. In one embodiment, the midsection housing incorporates an integrated oil sump for a four-cycle engine which is covered and isolated from outside contact by the two-piece cowl assembly and further, eliminates the need to have a separate oil sump reservoir.

One object of the invention is to provide a cowl assembly which provides isolation of the oil sump located within the midsection housing to prevent external contact with the hot oil sump and to maintain the oil temperature by isolating the oil sump from the splashing of external water in which the outboard drive operates.

Another object of the present invention is to provide a cowl assembly for muffling the noise of the engine exhaust traveling through the midsection housing of an outboard marine drive.

Yet another object of the invention is to provide a new midsection housing which encircles the exhaust passage in engine fluids for further muffling the noise of the engine exhaust traveling through the midsection housing.

A further object of the invention is to eliminate the expense involved in hand-sanding the die-cast driveshaft housing to provide a customer acceptable finish on the unattractive die-cast structure by using molded plastic cowl sections, which accept a paint finish directly out of the mold, for covering the die-cast midsection housing.

Yet another object is to provide a midsection housing and cowl assembly which permits an operator to easily drain engine oil completely and cleanly without removing the outboard drive from the boat and without having to remove the boat from the water. Further, the operator may drain the oil while remaining in the boat and need not enter the water.

Another object of the invention provides a simple and effective joint for easy assembly of the two cowl sections and maintaining the cowl sections in alignment.

BRIEF DESCRIPTION OF THE DRAWINGS

FIG. 1 is a side elevation view of an outboard marine drive.

FIG. 5 is a sectional view taken along line 5—5 of FIG. 4.

FIG. 6 is an enlarged sectional view taken along line 6—6 of FIG. 5.

DETAILED DESCRIPTION OF THE PREFERRED EMBODIMENT

Figure 2:
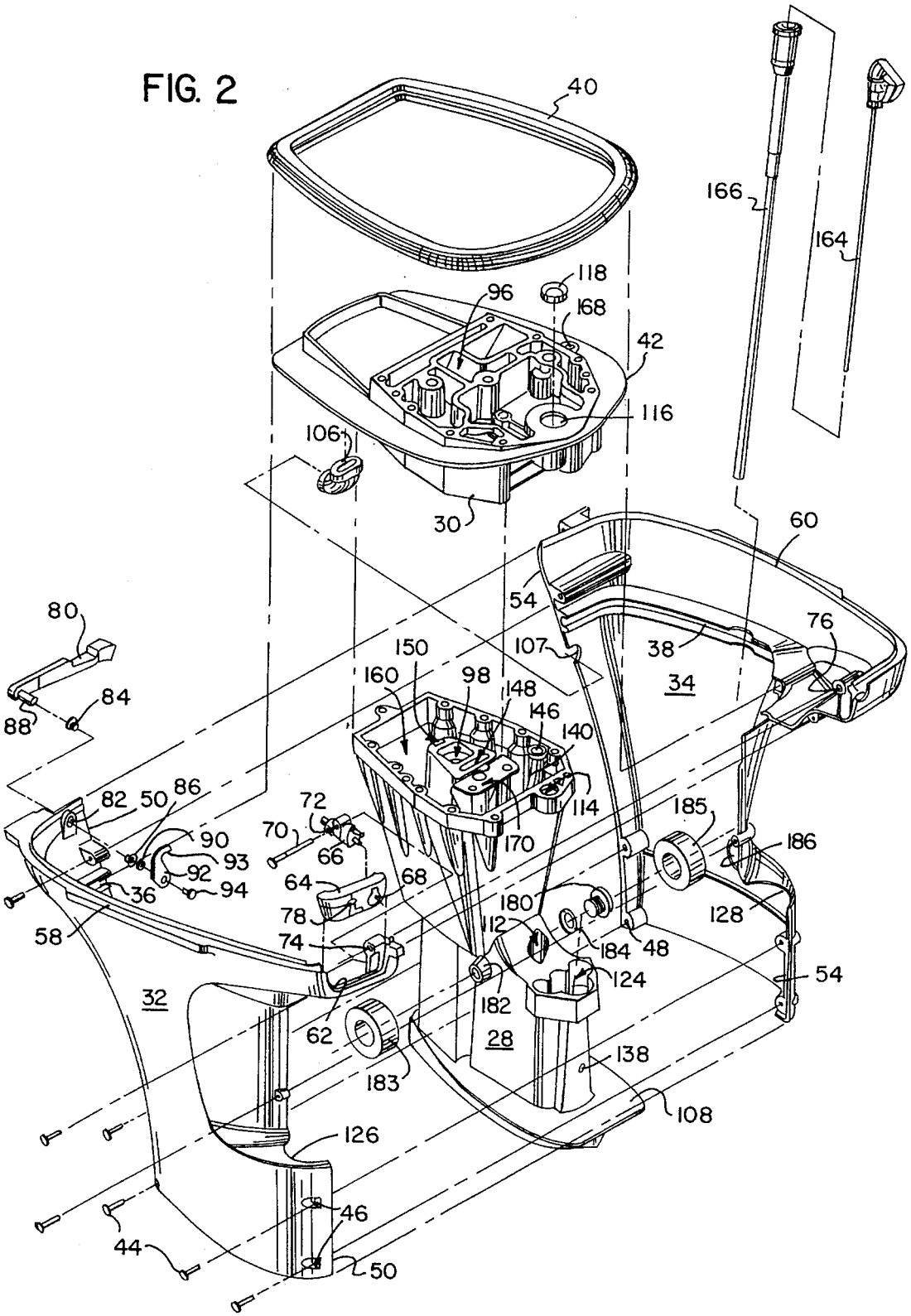
FIG. 2 is an exploded perspective view of a portion of the structure of FIG. 1.

As shown in FIG. 1 and in accordance with the present invention, an outboard marine drive 10 includes an upper power head 12, a lower gear case 14, and a midsection 16 which extends from power head 12 to gear case 14. A propeller 18 is provided at the aft end of gear case 14 for propelling a boat through water, as is well known. Water inlet openings 15 are provided in gear case 14 to supply cooling water to power head 12. The upper power head 12 includes an upper cowl assembly 20 with a bottom sealing edge 21, and midsection 16 includes a midsection cowl assembly 22 with a top sealing edge 23. Outboard drive 10 is mounted to a boat (not shown) about a mounting axis 24 and is rotatable about a steering axis 26, as is all well known.

Referring to FIG. 2, midsection 16 of FIG. 1, is further defined to include midsection housing 28 and adapter plate 30. Adapter plate 30 adapts the midsection housing 28 to power head 12, FIG. 1. The midsection cowl assembly 22 of FIG. 1, includes starboard cowl section 32 and port cowl section 34 which enclose midsection housing 28 and adapter plate 30 when assembled together. Cowl sections 32 and 34 have U-shaped sealing channels 36 and 38, respectively, which extend around the inside perimeter of each cowl section 32 and 34 such that when assembled, U-shaped channels 36 and 38 encircle compressible seal 40 which wraps sealing edge 42 of adapter plate 30. Cowl sections 32 and 34 are held together about midsection housing 28 and adapter plate 30 with fastening bolts 44 which extend through holes 46 of the starboard cowl section 32 and into the threaded bosses 48 of port cowl section 34. Tightening fastening bolts 44 into threaded bosses 48 draws channels 36 and 38 over compressible seal 40 and sealing edge 42 of adapter plate 30 to provide water resistant sealing in the area above adapter plate 30. Starboard cowl section 32 has edge portion 50 including tongue portion 52, FIG. 6. Port cowl section 34, FIG. 2, has edge portion 54 including grooved section 56, FIG. 6. Edge portions 50 and 54, FIGS. 2 and 6, cooperate to form a tongue and groove joint which eases installation and maintains the cowl sections in alignment.

Cowl sections 32 and 34, FIG. 2, have top edge portions 58 and 60, respectively, to form top sealing edge 23, FIG. 1, of midsection cowl assembly 22. Top sealing edge 23 of cowl assembly 22 cooperates with bottom sealing edge 21 of upper cowl assembly 20 to form a water resistant joint between upper cowl assembly 20 and midsection cowl assembly 22 with a compressible seal (not shown) therebetween, similar to that described in U.S. Pat. No. 4,875,883, incorporated herein by reference.

Starboard cowl section 32, FIG. 2, has opening 62 to receive fuel line connector seal 64. Fuel line connector 66 fits within hole 68 of seal 64 and is supported by bolt 70 extending through passage 72 of fuel line connector 66 and through passage 74 of cowl section 32. Bolt 70 is threaded into boss 76 of cowl section 34. Passage 78 of fuel line connector seal 64 is provided to accommodate either an electrical harness (not shown) on electronically controlled outboard drives, or for cables (not shown) on mechanically controlled outboard drives.

Lever latch 80, FIG. 2, is pivotally connected to starboard cowl section 32 by pin 88 extending through passage 82. Bushings 84 and 86 fit over pin 88 of lever latch 80 and fit into passage 82. Washer 90 and catch 92 are connected to pin 88 of lever latch 80 with fastener 94. When cowl sections 32 and 34 are assembled about midsection housing 28, and upper cowl assembly 20, FIG. 1, is in place over midsection cowl assembly 22, and latch lever 80 is in its horizontal position as shown in FIG. 2, catch 92 at engagement surface 93 engages a stationary pin (not shown) of the upper cowl assembly 20, and exerts sealing pressure compressing a sealing gasket (not shown), positioned between bottom sealing edge 21 of cowl assembly 20 and top sealing edge 23 of cowl assembly 22. This type of latching and sealing arrangement is known in the prior art, for example U.S. Pat. No. 4,800,854, incorporated herein by reference. The latch is released by rotating lever latch 80 counterclockwise, as viewed in FIG. 2, to a vertical position, such that catch 92 rotates counterclockwise, and engagement surface 93 disengages the stationary pin of upper cowl assembly 20.

Figure 3:
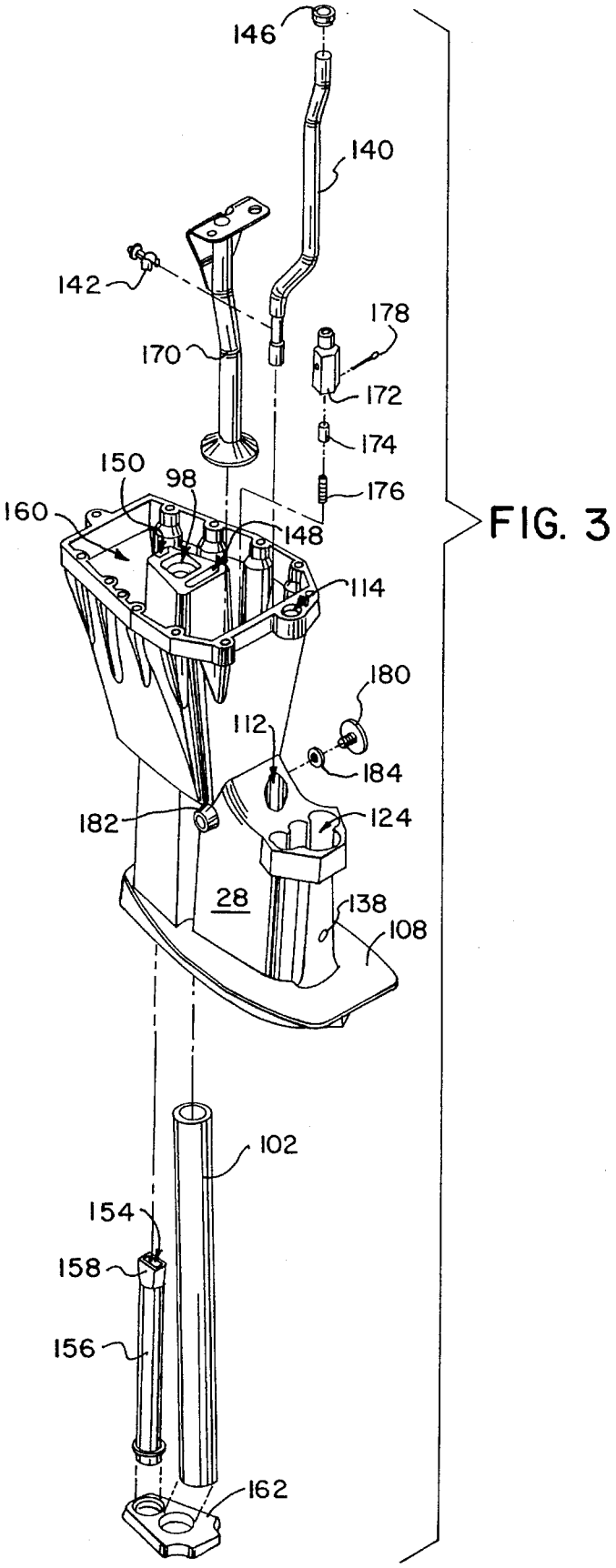
FIG. 3 is an exploded perspective view of a portion of the structure of FIG. 2.
Figure 4:
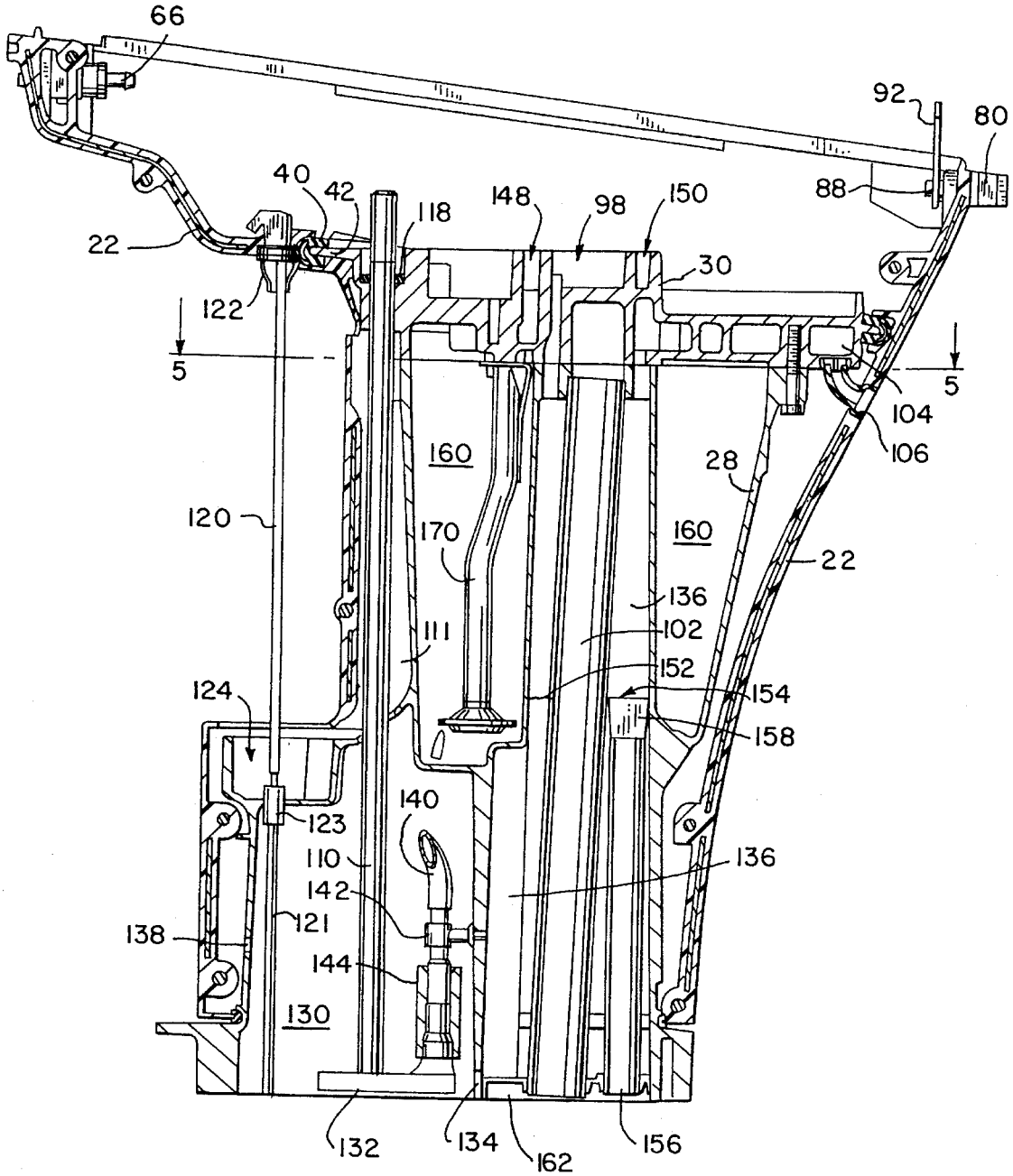
FIG. 4 is an enlarged partial sectional view of a portion of the structure of FIG. 1.

Engine exhaust created by an internal combustion engine as the power head 12, FIG. 1, is channeled through passage 96, FIG. 2, of adapter plate 30 from power head 12, FIG. 1. Engine exhaust is then channeled downwardly through passage 98, FIGS. 2–4, of midsection housing 28. Exhaust pipe 102, FIG. 3, fits into the bottom portion of passage 98 to transfer engine exhaust to the lower gear case 14, FIG. 1, where it is discharged through propeller 18, as is commonly known. However, during idle conditions, the water pressure about submerged propeller 18 creates excessive exhaust back pressure through exhaust pipe 102 and passage 98, FIG. 4. To provide a less restrictive path during idle conditions, exhaust relief passage 104, FIG. 4, is provided in adapter plate 30 as is well known and further described in U.S. Pat. No. 4,668,199 incorporated herein by reference. Exhaust relief boot 106, FIGS. 2 and 4, is press fit into relief passage 104 of adapter plate 30 and is provided to extend exhaust relief passage 104 through cowl assembly 22 at opening 107, FIG. 2. Semicircular opening 107, FIG. 2, in port cowl section 34 and a corresponding semi-circular opening in starboard cowl section 32 (not shown) provide an exterior passage for the exhaust relief boot 106 in assembled midsection cowl assembly 22, FIG. 1.

Midsection housing 28, FIG. 2, includes lower splashguard 108 extending horizontally, laterally and outwardly therefrom. Splashguard 108 blocks or restricts upward water flow into midsection cowl assembly 22, FIG. 1, when outboard drive 10 travels through a body of water. Driveshaft 110, FIG. 4, is forward of midsection housing 28 and passes through midsection housing 28 at passages 112 and 114, FIGS. 2 and 3, and through adapter plate 30 at passage 116, FIG. 2. Driveshaft 110, FIG. 4, is enclosed by midsection cowl assembly 22 creating driveshaft pocket 111. Driveshaft seal 118, FIGS. 2 and 4, prevents water from entering power head 12, FIG. 1. Upper shift shaft 120, FIG. 4, passes through midsection cowl assembly 22 through seal 122, and extends downwardly connecting lower shift shaft 121 at connector 123 and into gear case 14, FIG. 1, through outboard drive mounting passage 124, FIGS. 2–5. Cowl sections 32 and, 34, FIG. 2, have corresponding outboard drive mount openings 126 and 128, respectively, to accommodate the insertion of the swingable arm of a transom bracket into mounting passage 124 for attaching outboard drive 10 to the transom of a boat similar to that shown in U.S. Pat. No. 4,932,909, incorporated herein by reference.

Water pump cavity 130, FIG. 4, provides a water reservoir wherein water pump 132 is submerged which assures that water pump 132 is primed with water to provide consistent pumping. Water passage 134 connects discharge water cavity 136 and water pump cavity 130, and overflow drain hole 138 maintains the water level in water pump cavity 130 above water pump 132. Water pump 132 is driven by driveshaft 110 and draws cooling water from gear case 14, FIG. 1, through water inlet openings 15 and pumps cooling water vertically through supply tube 140, FIGS. 34, to power head 12, FIG. 1, as is all well known, for example U.S. Pat. No. 4,940,402, incorporated herein by reference. Water supply tube 140, FIGS. 3–4, is supported by bracket 142 and connected to water pump 132, FIG. 4, with water pump seal 144. Water supply tube seal 146, FIGS. 2–3, provides sealing between water supply tube 140 and adapter plate 30, FIG. 2.

Cooling water is circulated through power head 2, FIG. 1, and discharged through passages 148 and 150, FIGS. 2–5, filling discharge water cavity 136, FIG. 4, in midsection 28 to water level 152 corresponding to inlet 154 of stand pipe 156, thereby partially submerging exhaust pipe 102 in discharged coolant. Overflow drain hole 138, FIG. 4, in water pump cavity 130 and water passage 134 are sized small enough that water level 152 in discharge water cavity 136 is unaffected because of the much greater amounts of discharge water entering cavity 136 from power head 12. Stand pipe 156, FIGS. 3–4, provides a path to discharge cooling water through lower gear case 14, FIG. 1. Fluted end 158, FIGS. 3–4, of stand pipe 156, is inserted into cavity 136, FIG. 4, and is sized such that water level 52 is slightly above the bottom of oil sump 160. Stand pipe 156 and exhaust pipe 102 are held in place by retainer 62, FIGS. 3–4.

In four-cycle engine applications, oil sump 160, FIGS. 2–5, is formed by a hollowed upper half of midsection housing 28 and encircles discharge water cavity 136 and exhaust pipe 102 above water line 152. In this manner, exhaust pipe 102 is encircled by discharged coolant and oil thereby muffling the noise created by the engine exhaust traveling through exhaust pipe 102 to provide quieter operation. Oil dipstick 164, FIG. 2, and oil dipstick tube 166 enter oil sump 160 through passage 168 of adapter plate 30. Oil pickup 170, FIGS. 2–5, is submerged within oil sump 160 to withdraw oil from oil sump 160 for engine lubrication, as is well known. Oil pressure relief valve 172, FIG. 3, piston 174 and pressure relief spring 176 are assembled with retaining cotter pin 178 and mounted to adapter plate 30, FIG. 2, and positioned over oil sump 160, FIG. 3, to relieve excess oil pressure as is commonly known. Cowl sections 32 and 34, FIG. 2, forming midsection cowl assembly 22, FIG. 1, isolate oil sump 160 from both external contact, and from the cool water wherein the outboard drive 10, FIG. 1, is operated.

Figure 7:
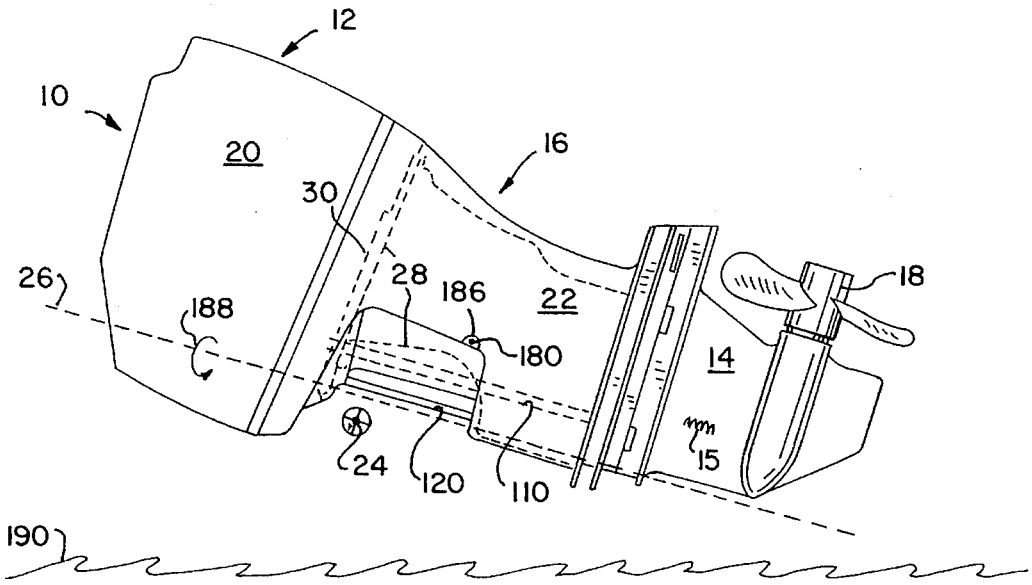
FIG. 7 is a rotated view of the structure of FIG. 1.

Threaded oil drain plug 180, FIG. 3, engages a threaded drain hole in a housing boss (not shown) similar to boss 182 in midsection housing 28. Boss 182 is provided to allow future adaptation of an alternative oil drain arrangement. Gasket 184 provides sealing between oil drain plug 180 and the housing boss drain hole. Donut shaped rubber dampers 183 and 185, FIG. 2, are placed between cowl sections 32 and 34, respectively, and midsection housing 28 to provide shock absorption and dampening for the lower ends of cowl sections 32 and 34. Rubber damper 183 is placed over boss 182 of midsection housing 28 and rubber damper 185 is placed over drain plug 180 and the corresponding housing boss (not shown). Cowl oil drain access 86, FIG. 2, in cowl section 34 provides external access to drain plug 180, FIG. 3, without disassembling cowl assembly 22, FIG. 1. This arrangement and position of oil drain plug 180, FIG. 3, allows an operator to drain engine oil completely without removing the outboard drive 10, FIG. 1, from the boat (not shown), by tilting outboard drive 10 about horizontal mounting axis 24 such that power head 12 is positioned over the boat, and gear case 14 is out of the water. As shown in FIG. 7, this position results in outboard drive 10 being tilted to an angle slightly less than 90°. Outboard drive 10 may then be turned about steering axis 26 to the full port side position, as shown by arrow 188, such that oil drain plug 180 and cowl oil drain access 186 face downwardly, and directly above, water line 190. While in this position, removing oil drain plug 180 permits engine oil to drain vertically without running down the side of the outboard drive 10. This arrangement and position allows an operator to drain engine oil directly into an oil drain pan (not shown) while remaining in the boat, without removing the outboard drive from the boat, and without spilling engine oil into the water. To further avoid spilling oil in the water, it is preferred that the oil drain pan be designed to float.

Figure 8:
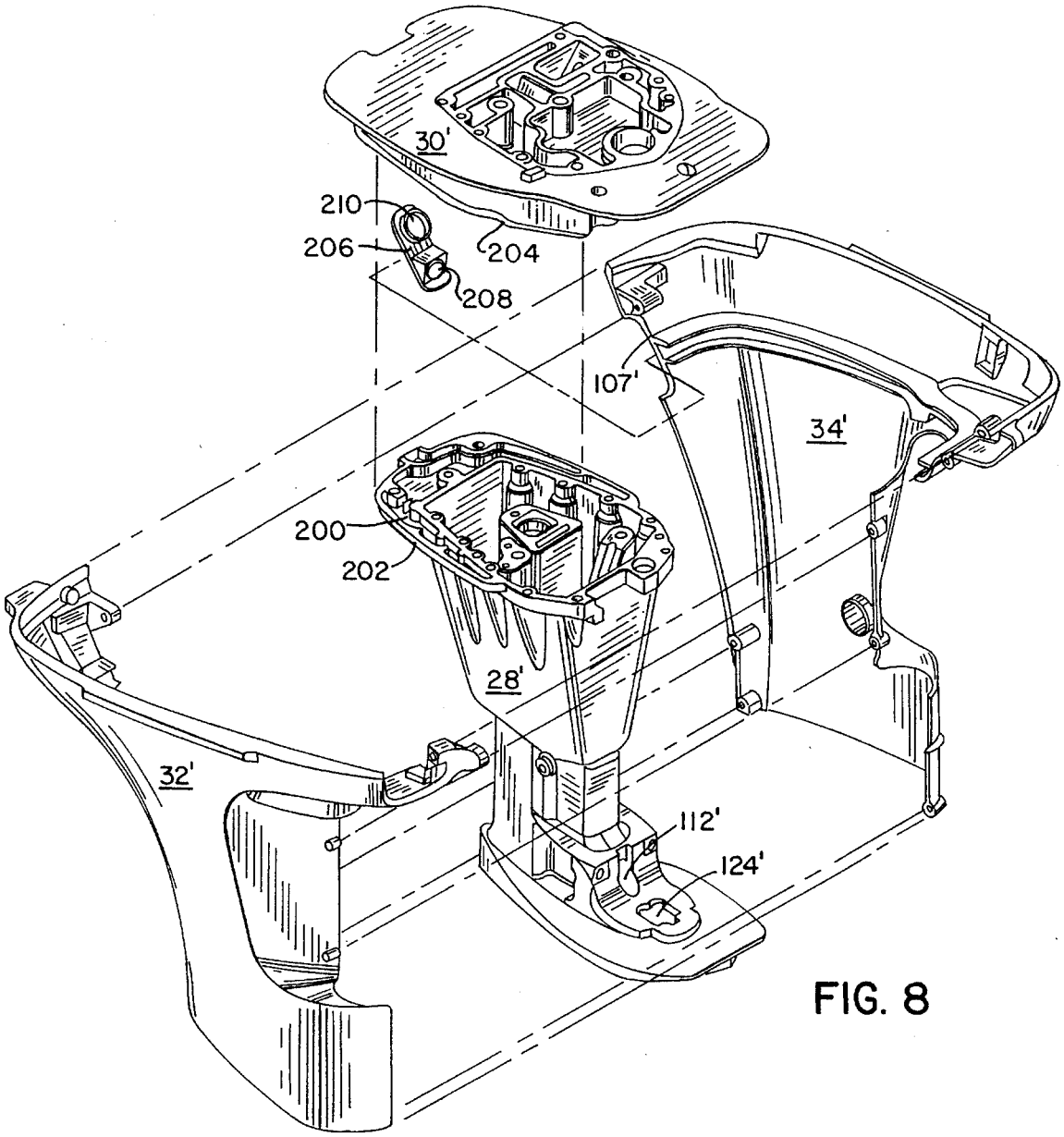
FIG. 8 is an exploded perspective view of a portion of the structure of another embodiment of FIG. 1.

FIG. 8 is similar to FIG. 2 and shows an alternative embodiment. Midsection housing 28' has an alternate mounting passage 124' and a corresponding lower driveshaft passage 112'. Midsection housing 28' also has an idle relief chamber 200 and corresponding flange 202 to accommodate alternate adapter plate 30' and gasket 204. Cowl sections 32' and 34' have enlarged openings 107' to accommodate boot 206 which has an exhaust relief passage 208 and a telltale water passage 210 to indicate the proper functioning of water pump 132, FIG. 4.

Figure 9:
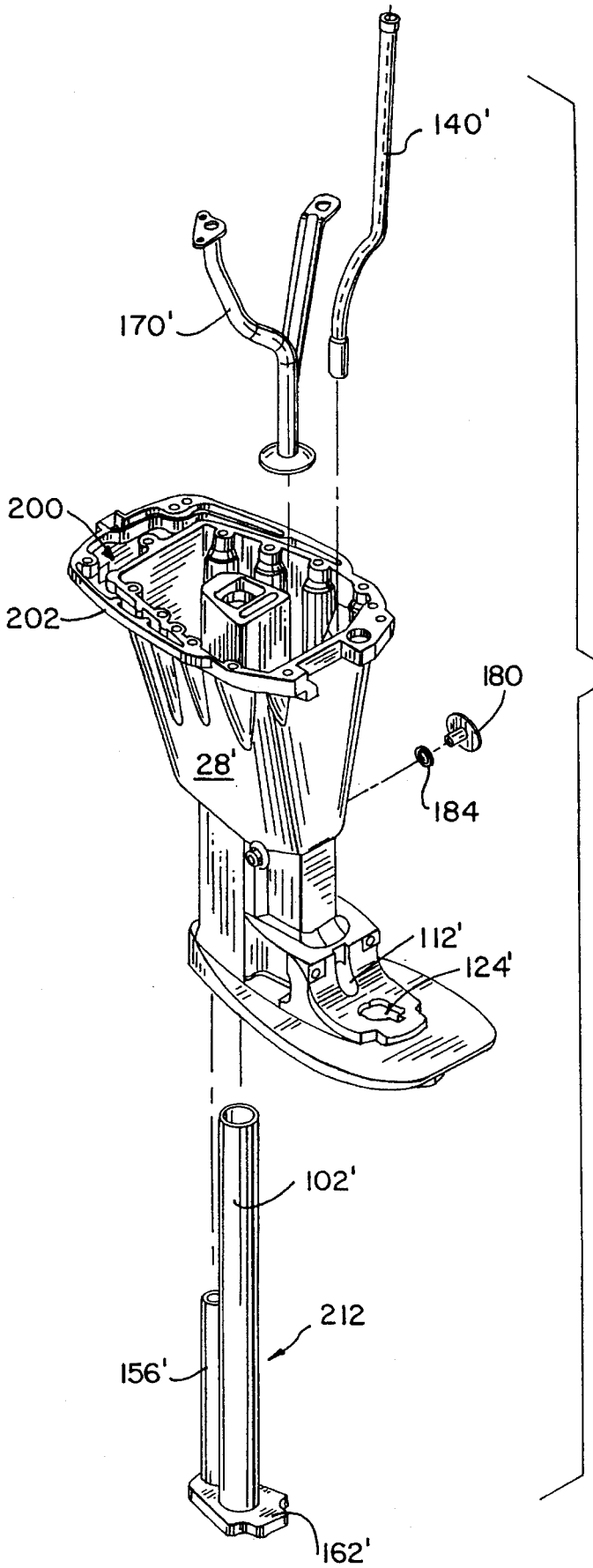
FIG. 9 is an exploded perspective view of a portion of the structure of FIG. 8.

FIG. 9 shows alternate midsection 28' having a modified oil pickup 170' and a modified water supply tube 140' to accommodate the alternate adapter plate 30', FIG. 8. FIG. 9 also shows unified exhaust pipe 102', standpipe 156', and retainer 162' as assembly 212 to ease installation.

As is evident from the embodiments shown, other various equivalents, alternatives, and modifications are possible and within the scope of the appended claims. It is recognized that the cowl sections of the current invention, may be made adaptable to existing marine drives.

We claim:

1. An outboard marine drive comprising:

a power head;

an upper cowl assembly enclosing the power head;

a lower gear case drivingly connected to the power head;

a midsection housing disposed between the power head and the lower gear case; and a midsection cowl assembly comprising a first cowl section and a second cowl section, wherein the first and second cowl sections adapt to fit together for enclosing at least a majority of the midsection housing and wherein the first and second cowl sections have edge portions which cooperate to form a joint between the cowl sections when the cowl sections are assembled together about the marine drive midsection housing.

2. The marine drive of claim 1 wherein the midsection housing has a lower, outwardly extending splashguard and wherein the cowl assembly extends from the upper cowl assembly to the lower splashguard.

3. The marine drive of claim 1 wherein the first cowl section edge portion has a lip and the second cowl section edge portion has a corresponding groove and the joint is formed by the groove of the second cowl section receiving the lip of the first cowl section.

4. The marine drive of claim 1 wherein the power head comprises a four-cycle internal combustion engine and the midsection housing further comprises an integral oil sump.

5. The marine drive of claim 4 wherein the oil sump is located in an upper half of the midsection housing.

6. The marine drive of claim 4 wherein the midsection housing further comprises an oil drain hole at a lower end of the oil sump, an oil drain plug to threadedly engage the oil drain hole and wherein the cowl assembly has a corresponding oil drain access.

7. The marine drive of claim 6 wherein the oil drain hole is situated on a side of the midsection housing and the marine drive is mounted to a boat and is capable of being tilted out of the water about a mounting axis and further turned about a steering axis wherein the oil drain hole faces substantially downwardly after said tilting and turning such that engine oil drains without running down the side of said drive.

8. The marine drive of claim 1 wherein:

the upper cowl assembly has a bottom edge portion;

the midsection cowl assembly has a top edge; and the midsection cowl assembly top edge cooperates with the upper cowl assembly bottom edge to form a joint sufficient for receiving a compressible seal in the joint.

9. An outboard marine drive comprising:

a lower gear case;

an upper power head comprising an exhaust producing, water cooled internal combustion engine;

a midsection between the lower gear case and the upper power head, the midsection having a hollowed interior;

an oil sump located within the hollowed midsection interior;

a water cavity located within the oil sump for discharged cooling water;

an exhaust passage located within the water cavity wherein engine exhaust is discharged through the exhaust passage which is encircled by engine cooling water and engine oil; and a midsection cowl assembly for enclosing at least a majority of the midsection comprising a first cowl section and a second cowl section, wherein the first and second cowl sections have edge portions which cooperate to form a joint between the cowl sections when the cowl sections are assembled together about the marine drive midsection.

10. The marine drive of claim 9 wherein the first cowl section edge portion has a lip and the second cowl section edge portion has a corresponding groove and the joint is formed by the groove of the second cowl section receiving the lip of the first cowl section.

11. The marine drive of claim 9 further comprising:

an upper cowl assembly enclosing the upper power head;

the upper cowl assembly having a bottom edge portion;

the midsection cowl assembly having a top edge which cooperates to form a joint between the upper cowl assembly bottom edge and the midsection cowl assembly top edge.

12. The marine drive of claim 9 further comprising:

an upper cowl assembly enclosing the upper power head;

the midsection having a lower, outwardly extending splashguard; and wherein the midsection cowl assembly extends from the upper cowl assembly to the lower splashguard.

13. An outboard marine drive comprising:

a lower gear case;

an upper power head;

a midsection housing connecting the lower gear case and the upper power head;

a driveshaft for driving the lower gear case in response to the upper power head wherein at least a portion of the driveshaft is exposed from the midsection housing; and a midsection cowl assembly for enclosing the midsection housing and the driveshaft comprising a first cowl section and a second cowl section, wherein the first and second cowl sections adapt to fit together to enclose the driveshaft and at least a majority of the midsection housing and wherein the first and second cowl sections have edge portions which cooperate to form a joint between the cowl sections when the cowl sections are assembled together about the marine drive midsection housing and driveshaft.

14. The marine drive of claim 13 wherein the exposed portion of the driveshaft is forward of the midsection housing and the first and second cowl sections extend forward of the exposed portion of the driveshaft and enclose the driveshaft forming a driveshaft pocket within the midsection cowl assembly.

15. The marine drive of claim 13 wherein the first cowl section edge portion has a lip and the second cowl section edge portion has a corresponding groove and the joint is formed by the groove of the second cowl section receiving the lip of the first cowl section.

16. The marine drive of claim 13 further comprising an upper cowl assembly enclosing the upper power head wherein the upper cowl assembly has a bottom edge portion and the midsection cowl assembly has a top edge portion which cooperate to form a joint between the upper cowl assembly bottom edge portion and the midsection cowl assembly top edge portion.

17. The marine drive of claim 16 wherein the midsection housing has a lower, outwardly extending splashguard and wherein the midsection cowl assembly extends from the upper cowl assembly to the lower splashguard.

18. An outboard marine drive comprising:

an upper power head;

a water cooled internal combustion engine within the upper power head;

a lower gear case;

a midsection between the lower gear case and the upper power head;

an engine exhaust pipe within the midsection and having a length substantially equal to a length of the midsection;

an engine cooling water discharge cavity within the midsection and encircling the exhaust pipe.

19. The marine drive of claim 18 wherein the exhaust passage of the midsection is at least partially submerged in discharged coolant water.

20. The marine drive of claim 19 further comprising an engine oil sump within the midsection and at least partially encircling the exhaust passage.

21. The marine drive of claim 20 wherein the exhaust passage is partially submerged in coolant water and the remainder of the exhaust passage is encircled by engine oil.

22. The marine drive of claim 18 further including a cowl assembly for enclosing the midsection comprising a first cowl section and a second cowl section, wherein the first and second cowl sections adapt to fit together enclosing at least the majority of the midsection and wherein the first and second sections have edge portions which cooperate to form a joint between the cowl sections when the cowl sections are assembled together about the marine drive midsection.

23. The marine drive of claim 22 wherein the first cowl section edge portion has a lip and the second cowl section edge portion has a corresponding groove and the joint is formed by the groove of the second cowl section receiving the lip of the first cowl section.

24. The marine drive of claim 23 which further includes an upper cowl assembly enclosing the upper power head and the upper cowl assembly having a bottom edge portion and the midsection cowl assembly having a top edge portion which cooperate to form a joint between the upper cowl assembly bottom edge portion and the midsection cowl assembly top edge portion.

25. An outboard marine drive comprising:

an upper power head;

a water cooled internal combustion engine within the upper power head;

a lower gear case;

a midsection between the lower gear case and the upper power head;

an engine exhaust passage within the midsection;

an engine cooling water discharge cavity within the midsection and encircling the exhaust passage;

a cowl assembly for enclosing the midsection comprising a first cowl section and a second cowl section, wherein the first and second cowl sections adapt to fit together enclosing at least the majority of the midsection and wherein the first and second sections have edge portions which cooperate to form a joint between the cowl sections when the cowl sections are assembled together about the marine drive midsection; and wherein the midsection has a lower outwardly extending midsection splashguard and wherein the midsection cowl assembly extends from the upper cowl assembly to the lower splashguard.

26. A method of draining engine oil from an outboard marine drive mounted on a boat and placed in water, the outboard marine drive having a midsection cowl assembly enclosing a majority of a midsection of the outboard marine drive and an internal oil sump, said method comprising the steps of:

tilting the outboard marine drive out of the water about a mounting axis;

turning the outboard marine drive about a steering axis; and removing an oil drain plug accessible from within the boat and draining the engine oil without removal of the midsection cowl assembly.

* * * * *